United States Patent [19]

Lindal

[11] 4,065,902

[45] Jan. 3, 1978

[54] SHEETMETAL COVERED ROOF PLANKS HAVING WATERPROOF JOINTS

[76] Inventor: Sir Walter Lindal, 1120 8th Ave., No. 1702, Seattle, Wash. 98101

[21] Appl. No.: 735,170

[22] Filed: Oct. 26, 1976

[51] Int. Cl.[2] ..... E04C 2/26; E04C 2/20

[52] U.S. Cl. ..... 52/622; 52/404; 52/528; 52/556; 52/593; 52/615

[58] Field of Search ..... 52/528, 556, 622, 593, 52/595, 510, 404, 621, 408, 409, 412, 615

[56] References Cited

U.S. PATENT DOCUMENTS

| | | | |
|---|---|---|---|
| 1,864,774 | 6/1932 | Storm | 52/622 X |
| 2,063,159 | 12/1936 | Groove | 52/528 X |
| 2,169,428 | 8/1939 | Pattiani | 52/528 X |
| 2,596,280 | 5/1952 | Nystrom | 52/622 X |
| 2,739,677 | 3/1956 | Greulich | 52/404 X |
| 2,797,448 | 7/1957 | Revell et al. | 52/622 |
| 3,131,442 | 5/1964 | Persson-Melin | 52/556 X |
| 3,237,361 | 3/1966 | Norman, Jr. | 52/556 X |
| 3,479,784 | 11/1969 | Massagli | 52/622 |
| 3,706,172 | 12/1972 | Keith | 52/595 |
| 3,886,704 | 6/1975 | Mattes | 52/556 X |

FOREIGN PATENT DOCUMENTS

| | | | |
|---|---|---|---|
| 253,878 | 5/1963 | Australia | 52/593 |
| 12,248 | 10/1842 | France | 52/595 |
| 847,060 | 9/1960 | United Kingdom | 52/556 |

*Primary Examiner*—Leslie Braun

[57] ABSTRACT

Common tongue and groove roof decking planks are covered with sheetmetal to make the planks themselves weatherproof. The sheetmetal is formed so that the individual planks can be interlocked together with a weatherproof joint which also hides from view and the weather the nails used to spike the roof planking down to the roof framing.

8 Claims, 15 Drawing Figures

SHEETMETAL COVERED ROOF PLANKS HAVING WATERPROOF JOINTS

FIELD OF INVENTION

This invention relates to an improvement in roof construction, which enables the application of roof planking and sheetmetal roofing in a single operation instead of two separate operations.

SUMMARY OF INVENTION

At the present time all buildings having sheetmetal roofs are first framed and then sheeted in with roof boards either tightly together or spaced. Then, sheets of metal with interlocking weatherproof joints are applied. My invention combines the roof planking operation with the sheetmetal operation producing a solid planked and sheetmetal covered roof in one operation allowing the use of highly efficient, less expensive plant labor to cut the cost of more expensive and more cumbersome field labor and quicken the building process. In the plant, the sheetmetal can be formed and locked mechanically to the wood planking and also totally tied to the planking with adhesive in one machine operation using equipment now available in the trade. This combination cummulates the strength of each member, the wood and the metal, and they together are much stronger than when they are separate. Today, the roof board or plank must be designed to carry the weight of the sheetmetal as a dead load. My invention permits the roof plank to span a greater distance because the sheetmetal strengthens the plank instead of weighing it down, Tongue and groove roof planks alone are not waterproof. The sheetmetal adds waterproof joints and surface to the planks. There are many methods and patterns used in the trade to make interlocking weatherproof joints between sheets of metal roofing. My invention provides a marriage between wood and sheetmetal to produce a structural weatherproof plank for roof surfaces. Only two designs for interlocking joints are shown though there are many other jointing methods. One is designed primarily for vertically sloped planking running from eave to ridge across horizontal roof beams. The second design is even more waterproof and is for roof planks that are applied horizontally across sloped beams, rafters or trusses that run from the eave to the ridge. An even quicker to apply roof assembly is afforded by producing a roof section containing several roof planks, tied together by cleats with a wide single sheet of metal preformed ans stretched across the planks and snapped to the sides of the section. A further modification of this invention enables the insertion of board type insulation between the metal and the wood in either single metaled planks or sections of planks providing a winterized version of the same products, without the need of inside finish panelling to hide the insulation.

DESCRIPTION OF THE PREFERRED EMBODIMENTS

Figure 1:
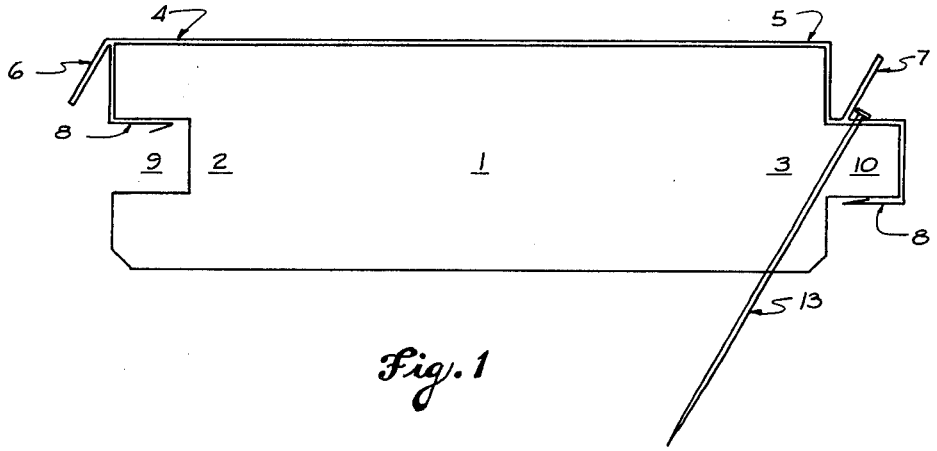
FIG. 1 illustrates a standard wood tongue and groove plank covered on the top side with sheetmetal which is folded around and into the tonque and groove and has interlocking folds on each edge.
Figure 2:
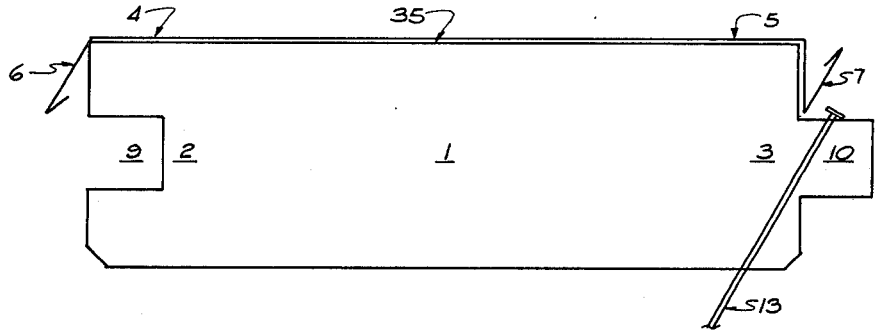
FIG. 2 shows a similar plank covered with sheetmetal which has been attached to the wood with an adhesive.
Figure 3:
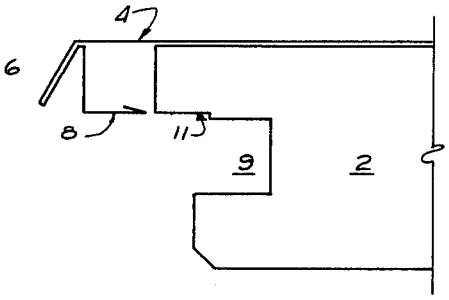
FIG. 3 shows the female side of a modified plank with its sheetmetal cover in an exploded view to better illustrate the modifications.
Figure 4:
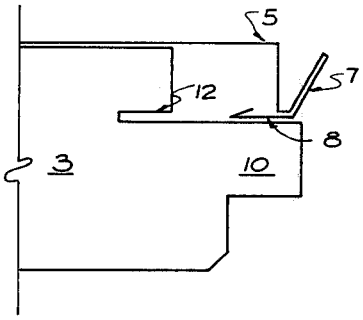
FIG. 4 illustrates an exploded view of the male end of a modified plank and its metal cover to clearly show the modifications.
Figure 5:
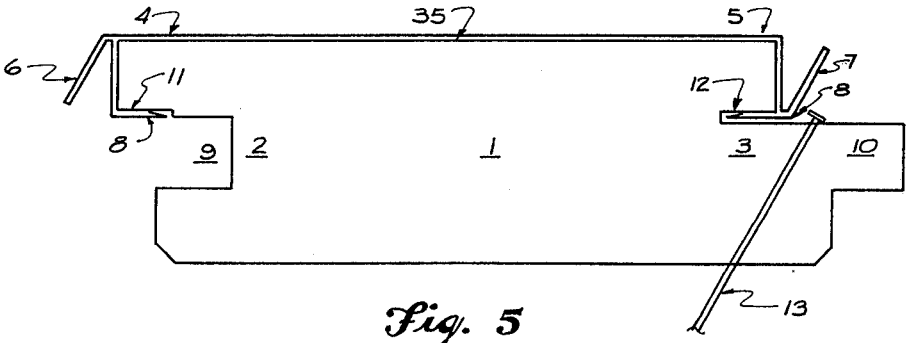
FIG. 5 is a modified plank and sheetmetal assembly ready for use.
Figure 6:
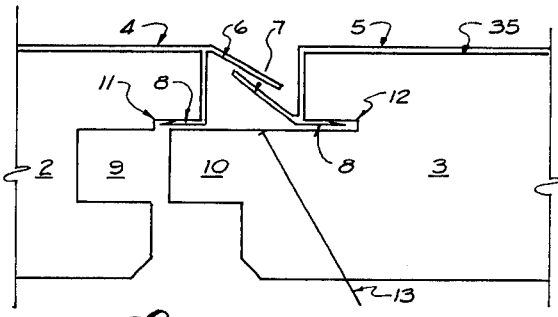
FIG. 6 shows the male side of the metal covered plank nailed down with the female side of another plank being moved towards it into a locking position.
Figure 7:
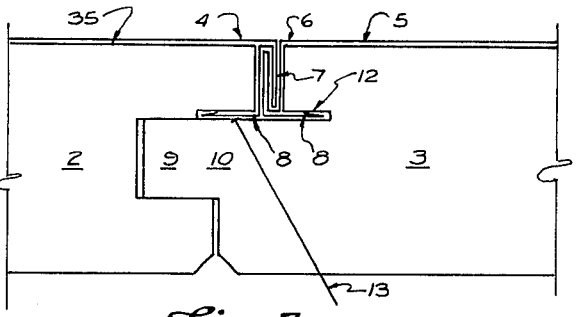
FIG. 7 shows a closed joint between two planks installed in a building.
Figure 8:
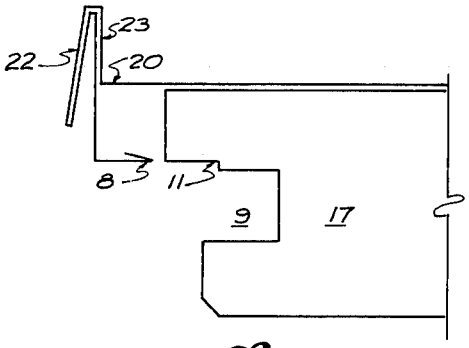
FIG. 8 is an exploded view illustrating a further modified type of joint.
Figure 9:
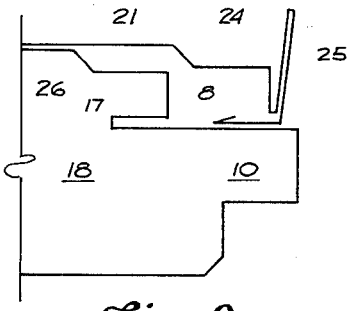
FIG. 9 is similar to FIG. 8 showing an exploded view of the other edge of the plank illustrating modifications.
Figure 10:
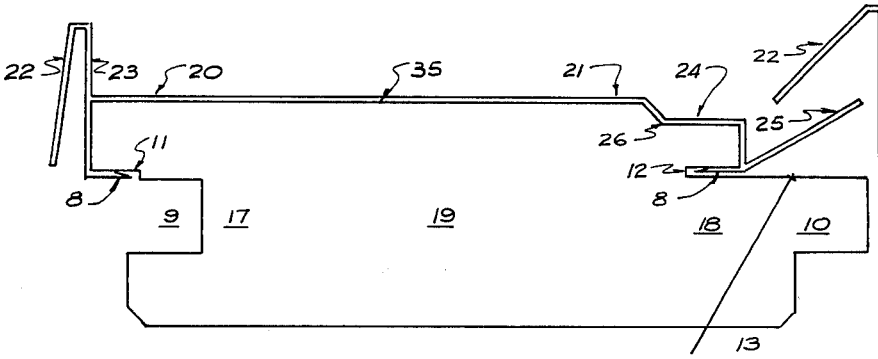
FIG. 10 shows a completely finished further modified plank being installed in a building.
Figure 11:
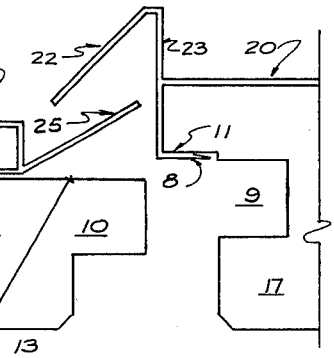
FIG. 11 shows the female end of a further modified plank being moved into locked position with a fixed plank.
Figure 12:
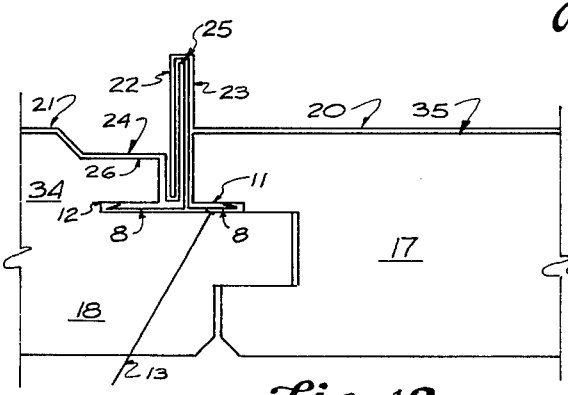
FIG. 12 shows the planks locked together and nailed into place.
Figure 13:
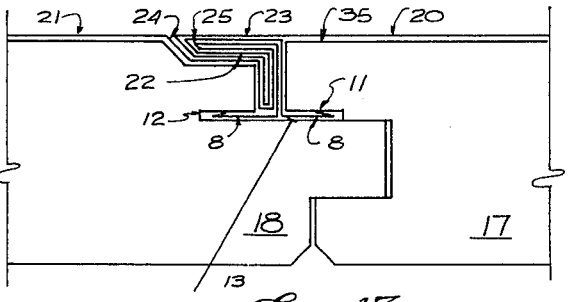
FIG. 13 shows how the protruding folds of the metal, shown in FIG. 12, have been hammered or bent down to further improve the joint.
Figure 14:
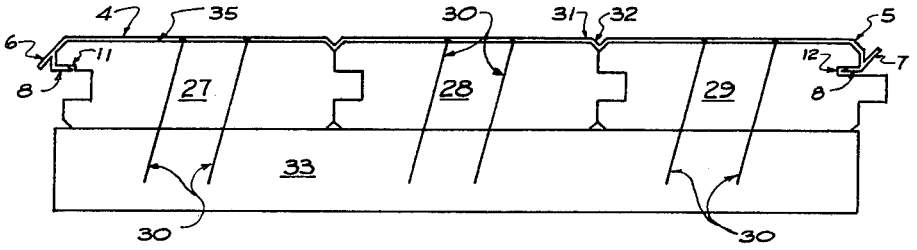
FIG. 14 shows a sheetmetal covered roof section containing 3 wood planks.
Figure 15:
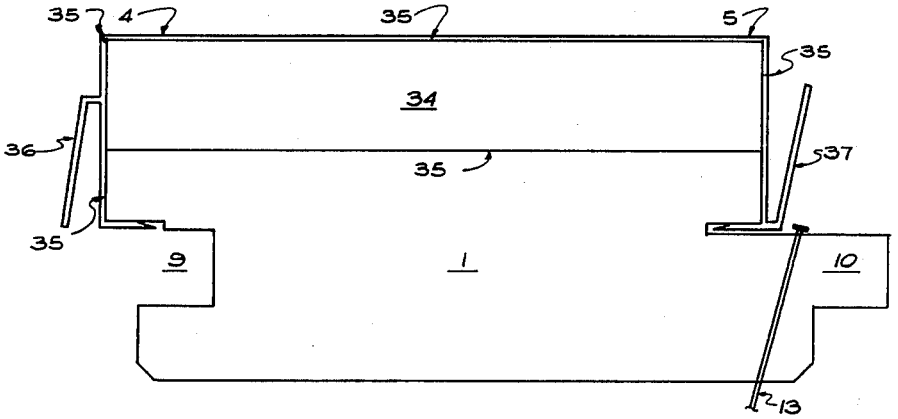
FIG. 15 shows a modified wood plank with a layer of insulating board between it and the sheetmetal.

FIGS. 1 to 7 and 14 and 15 illustrate sheetmetal covered wood planks with waterproof joints primarily designed for use where the planks are sloped vertically across horizontal roof beams. FIGS. 8 to 13 illustrate sheetmetal covered wood planks with a weatherproof joints designed for use where the roof planks run horizontally across sloped rafters, beams or trusses. In each plank drawing, the plank itself is indicated by 1. The female side is 2 and the male side is 3. The female side of the metal is 4 and the male side is 5. The metal fold 6 slopes downward from the top of the plank on the female side and the metal fold 7 points upward from the tonque at the male side. 8 is the end or tip of the sheetmetal. FIG. 5 shows the metal edge which is reinforced by doubling back, inserted into the main groove at the female side and into a special groove under the tonque on the male side. The plank groove is 9 and the tongue is 10. The groove 9 is modified with a groove widening for half its depth, shown as 11. The special small groove at the tongue side is 12. Nails holding down the roof planks to the roof framing are 13. The further modified plank having the extra groove or notch 26 is numbered 19 and 17 is its female side and 18 its male side. In application, this plank would be sloped sideways and the end 18 would be higher than the end 17. The sheetmetal cover for the female side is 20 and the male side is 21. The side 20 is further modified with the metal fold 23 running vertically approximately the same length as 6 and then the fold is returned in a downward slope 22 to almost reach the level of the tongue 10. The sheetmetal side 21 is modified by downward turn 24 which follows the notch 26 and the flattened fold 25 is twice the length of the fold 7. 28 is a standard vee-jointed tongue and groove plank. 27 is the same plank but modified at 11, the same as the other planks. 29 is the same as 28 but has the same special groove 12 as shown before. A nail 30 is used to assemble the roof section. The vee groove in the plank 32 is matched by a vee groove in the sheetmetal 31. The battens 33 tie the section together and it itself is used to nail the section to the beams it lies across. The adhesive 35 (which is preferably the variety known as elastomatic which allows for movements of the metal and wood) is noted at all figure drawings where it can be used. 34 is board insulation, fiberboard or urathane of one of many other types. 36 and 37 are elongated metal folds.

What I claim my invention is:

1. A composite sheetmetal covered roofing plank made up as a section of at least two but not more than five, tongue and groove wood planks nailed to the top of at least two cross cleats having a length slightly less than the width of the section an dimensions each equal to the plank thickness with the individual planks having all corners finished in a vee-joint pattern and the sections's edge plank with a groove exposed having the groove slightly widened on its top side to accommodate the thickness of the sheetmetal and the other edge plank with a tongue exposed having a special small groove machined into it, inward the depth of the plank's groove into the plank from the surface of the tongue and on the plane of the tongue to accommodate the thickness of the sheetmetal; said sheetmetal covering is formed so it will clamp into the groove of the section's edge plank, set into the vees between the planks on the section's top surface and snap into the special groove of the plank on the section's other edge; the said sheetmetal is further formed so that two flat folds protrude out of its surface near its edges one being at the section's groove edge at the bottom of the vee and the other being just above the small groove on the section's tongue edge with the flattened folds having a length slightly less than the width of the plank's edge surface between the vee and the groove; said folds being set at an angle close enough to the edge plank's edges to be out of the way during handling and shipping and far enough away to permit the insertion of a pencil-like tool to open out the angle of the folds at the construction site, along the full length of the section so that when one section is nailed into place a second similar section can be driven by hammering the cleat ends so that the groove of the second section engages the tongue of the first section and its metal fold misses the edge of the first section's metal fold, but each fold strikes the opposing section's edge so that they are driven together and squeezed tightly together between the section edges forming a water-proof joint; said section cleats are placed so that they will occur at planned cross bearers at the construction job so that the sections can be nailed to the cross bearers from the section's underside by nailing the cleats to the cross bearers.

2. A composite roofing plank made up of a tongue and groove wood plank covered with an insulating board which in turn is covered with sheetmetal which is fastened to the wood plank's edges thus covering the insulation board edges; said wood plank's tongue has a top surface twice as wide as its bottom surface and its groove is wider on the top by having a notch machined out of it to half its depth and which widens the groove opening a distance equal to two sheetmetal thicknesses; a small groove is cut into the plank at the tongue edge the same size and on the same plane as the notch in the groove edge and the width of the top surface of the tongue is wider than the top surface of the groove by a distance equal to slightly more than six sheetmetal thicknesses; said insulation board can be any desired thickness to meet required insulation quality, but for practical purposes should not be thicker than twice the plank's thickness with its width being exactly the same as the width of the top surface of the plank; said sheetmetal covering is formed so as to set into the widened portion of the plank's main groove, going upward over the plank's top groove edge, over the insulation board's edges and top surface, over the plank's top tongue edge and to snap into the small groove at the plank's tongue with both sheetmetal edges turned upwards and back slightly to reinforce the edges and to form a barb to hold the edges into said small groove and notch; said sheetmetal is further formed so as to have two flattened folds protrude out of its surface near its edges, one approximately halfway up on the edge of the insulation board at the plank's groove edge and extending downwards to near the level of the top of the groove and the other one at the opening of the small groove at the plank's tongue edge and being the same length as the first fold with both folds being set close enough to the plank's edge and the insulation edge so as to be out of the way during handling and shipping, but far enough away to allow the insertion of a pencil-like tool to open out the angle of the folds at the construction site along the full length of the plank so that when one plank is nailed down to a cross bearer, with the nail being situated just outside the tongue fold and driven anglewise a second similar composite plank can be driven so that its groove engages the tongue of the first plank and its metal fold just misses the edge of the first plank's metal fold, but each fold strikes the opposing plank's edge so that they are driven together and when the second plank is similarly angled nailed, the metal folds are squeezed tightly together between the plank edges forming a water-proof joint and also covering the head of the nail driven into the first plank.

3. A composite roofing plank made up of a tongue and grooved wood plank covered on its topside with sheetmetal attached to the plank's edges which has metal folds protruding from its edges for interlocking purposes with other similar roofing planks; said tongue has a top surface twice as wide as its bottom surface and said groove has a notch machined out of its top surface to half the groove's depth and which widens the groove opening a distance equal to two thicknesses of the sheetmetal covering; a small groove is cut into the planks' edge at the tongue just above the tongue the same size and on the same plane as the aforementioned notch in the groove and the width of the top surface of the tongue is wider than the top surface of the groove by a distance equal to slightly more than six thicknesses of the sheetmetal; said tongue and groove wood plank has a notch-like groove machined out of its top surface beginning at the plank's top corner at the tongue edge which has a depth equal to slightly more than six thicknesses of sheetmetal and width slightly more than a third of the plank's thickness with an obtuse angled end approximately 135° to the plank's surface; said sheetmetal covering is formed so that it clamps into the aforementioned notch space in the plank's groove, covers the plank's upper groove edge, covers the plank's top surface going into the contour of oblique sided notch, over the plank's upper tongue edge and snaps into the small groove at the tongue with both sheetmetal edges being doubled back and upwards slightly to reinforce the edges and to form a barb to hold the edges into the said notch space in the main groove and the small groove; said sheetmetal is further formed so as to have two flattened folds protruding out of its top surface, one is located at the plank's top corner at the groove edge and the other fold is located just above the small groove at the tongue edge, said fold at the tongue edge is slightly shorter than the tongue's length and is set along the tongue at a slight upward angle; said fold at the groove edge extends vertically upwards from the plank's surface to a point which is the length of the tongue fold from the top of the plank's main groove and then is bent sharply back at a close angle to the plank's edge terminating at the groove opening; said angles between the tongue fold and the tongue and also between the groove fold and the plank's edge is open enough so that there is room left for the insertion of a pencil-like tool to open out the angle of the folds at the construction site, along the full length of the roofing plank so that when one plank is nailed down to a cross bearer, with the nail being situated just outside the tongue fold and driven anglewise, a second similar roofing plank can be driven so that its groove engages the tongue of the first plank and its metal fold just misses the tip of the first plank's metal fold, but each fold strikes the opposing plank's edge so that the folds are driven together and when the second plank is similarly angle nailed the metal folds are squeezed tightly together between the plank's edges forming a water-tight joint and also covering the head of the nail driven into the first roofing plank; said water-proof joint has the capacity to be further improved after the planks are assembled by bending the interlocking sheetmetal folds which would protrude past the plank's surface, with hammer blows, into the oblique edged notch on each plank's surface.

4. A composite roofing plank made up of a tongue and grooved wood plank covered on its topside with sheetmetal attached to the plank's edges; said plank's tongue has a top surface twice as wide as its bottom surface and said groove is wider on the top by having a notch machined out of it to half the groove's depth and which widens the groove opening a distance equal to the two thicknesses of the sheetmetal covering; a small groove is cut into the plank's edge at the tongue just above the tongue the same size and on the same plane as the aforementioned notch in the groove and the width of the top surface of the tongue is wider than the top surface of the groove by a distance equal to slightly more than six sheetmetal thicknesses; said sheetmetal covering is formed so that it clamps into the aforementioned notch space goes over the top edges and surface of the wood plank and snaps into the small groove at the tongue with both sheet-metal edges doubled back and upwards slightly to reinforce the edges and to form a barb to hold the edges into said notch space and small groove; said sheetmetal is further formed so as to have two flattened folds protruding out of its top surface, one is located at the plank's top corner at the groove edge and the other fold is located just above the small groove at the plank's tongue edge and they are both slightly less in length than one third of the plank's thickness and are set to slant slightly away from the plank's edges, close enough to be out of the way for handling and transporting, but far enough away that there is room left for the insertion of a pencil-like tool to open out the angle of the folds at the construction site, along the full length of the roofing plank so that when one plank is nailed down to a cross bearer, with the nail being situated just outside the tongue fold and driven anglewise, a second similar roofing plank can be driven so that its groove engages the tongue of the first plank and its metal fold just misses the tip of the first plank's metal fold, but each fold strikes the opposing plank's edge so that they are driven together and when the second plank is similarly angle nailed the metal folds are squeezed tightly together between the plank edges forming a water-tight joint and also covering the head of the nail driven into the first roofing plank.

5. A composite roofing plank made up of a tongue and groove wood plank having a sheetmetal covering attached to its top surface by an adhesive, preferably an elastomatic adhesive and which extends downward and outwards from the plank's top corner at its groove edge, a length slightly less than a third of the plank's thickness and is returned slightly to reinforce the metal edge and which follows the plank's tongue edge to the tongue and then extends upwards and outwards and returns slightly, similar to the metal extension at the groove edge; said metal extensions are set close enough to the plank's edge so as to be out of the way for shipping and handling purposes, but far enough away that there is room left for the insertion of a pencil-like tool to open out the angle of the metal extensions at the construction site, along the full length of the plank so that when one plank is nailed down to a cross bearer, with the nail being situated just outside the metal extension at the tongue and driven anglewise, a second similar plank can be driven so that its groove engages the tongue of the first plank and its metal extension just misses the edge of the first plank's extension, but each extension strikes the opposing plank's edge so that they are driven together and when the second plank is similarly angled nailed, the metal extensions are squeezed tightly together between the plank edges forming a water-tight joint and also covering the head of the nail driven into the first plank.

6. A composite roofing plank made up of a tongue and groove wood plank covered on its topside with sheet material fastened to the plank on its groove edge by being formed into the groove, and on its tongue edge by being formed around and under the tongue; said sheet material is further formed by having two flattened folds, a first flattened fold is located at the plank's top corner at the groove edge and extends downwardly and outwardly from the top corner and the second flattened fold is located at the base of the plank's tongue on the top side of the tongue and extends upwardly and outwardly therefrom and the folds are both slightly less in length than one third of the plank's thickness; said folds are close enough to the plank's edges to be out of the way for handling and transporting, but far enough away that there is room left for the insertion of a pencil-like tool to open out the angle of the folds at the construction site, along the full length of the plank so that when one plank is nailed down to a cross bearer, with the nail being situated just outside of the tongue fold and driven anglewise, a second similar plank can be driven so that its groove engages the tongue of the first plank and its fold just misses the edge of the first plank's fold, but each fold strikes the opposing plank's edge so that they are driven together and when the second plank is similarly angle nailed, the folds are squeezed tightly together between the plank edges forming a water-proof joint and also covering the head of the nail driven into the first plank; said sheet material is further formed to provide reinforced edges by doubling back the sheet material slightly at the edges.

7. A composite roofing plank made up as in claim 6 using sheet material which is sheet plastic.

8. A composite roofing plank made up as in claim 6 using sheet material which is sheetmetal.

* * * * *